United States Patent [19]

Guglielmi

[11] Patent Number: 4,770,307

[45] Date of Patent: Sep. 13, 1988

[54] CAP FOR THE AIRTIGHT-SEALING OF BOTTLES

[76] Inventor: Danilo Guglielmi, 8 Via 25 Aprile, 36010 Monticello Conte Otto (Vicenza), Italy

[21] Appl. No.: 55,054

[22] Filed: May 28, 1987

[30] Foreign Application Priority Data

May 29, 1986 [IT] Italy ..... 85559 A/86

[51] Int. Cl.[4] ..... B65D 45/32

[52] U.S. Cl. ..... 215/272

[58] Field of Search ..... 215/272, 293

[56] References Cited

U.S. PATENT DOCUMENTS

| | | | |
|---|---|---|---|
| 1,834,548 | 12/1931 | Noble | 215/272 |
| 2,059,932 | 4/1935 | Cavuoti | 215/272 |
| 2,132,775 | 10/1938 | Casablancas | 215/272 |
| 3,863,798 | 2/1975 | Kurihara et al. | 215/272 |
| 4,534,482 | 8/1985 | Bouché | 215/272 |
| 4,634,029 | 1/1987 | Hauser | 215/272 |

*Primary Examiner*—Stephen Marcus
*Assistant Examiner*—Nova Stucker
*Attorney, Agent, or Firm*—Birch, Stewart, Kolasch & Birch

[57] ABSTRACT

A cap particularly suited for providing an airtight sealing for bottles having a peripheral lip on the neck thereof which comprises first and second substantially cylindrical bodies. The first cylindrically body being coaxially and slidably disposed within the second cylindrical body and being closed at one end, a washer disposed within the first cylindrical body and adapted to seal the opening of the bottle, a first spring disposed between the washer and the closed end of the first cylindrical body, a second spring disposed between the first and second cylindrical bodies, the second spring being biased, against the slidable movement of the first and second cylindrical bodies relative to each other, a plurality of engaging members operatively confined by the first and second cylindrical bodies and adapted to move in the horizontal and vertical direction whereby upon the application of pressure on the second cylindrical body in the downward, vertical directions against the bias of the second spring, the plurality of engaging members are displaced to move in substantially the vertical and horizontal direction to engage below the lip on the neck of the bottle.

4 Claims, 2 Drawing Sheets

CAP FOR THE AIRTIGHT-SEALING OF BOTTLES

DESCRIPTION

The present invention relates to a cap for the airtight closing of bottles having a neck with an inwardly indented edge.

Most of the bottles which are used for bottling drinkable liquids, such as mineral water, fruit juices, orangeade, soft drinks, etc., contain a circular inwardly indented edge, suitable for receiving a crown cap.

Other bottles, particularly those used for wine and sparking wine, do not contain an indentation on the edge of their necks suitable for receiving a crown cap, but nevertheless they contain a circular indentation.

Once the above-mentioned bottles are opened and the liquid contained therein is not completely used up at once, it becomes necessary to re-seal the bottles to be airtight in order to prevent the spilling of the liquid and to preserve the quality of the liquid in the best possible way.

For this reason, in order to efficiently re-seal the already opened bottles, airtight-sealing caps have been manufactured and marketed.

One of the known constructions consists essentially of an upper part presenting a circular surface which contrasts, by means of a spring, with the ring-shaped surface of the bottle opening. The upper part comprises two components hinged to one another, which separate from one another when the cap is pushed against the neck of the bottle. In each of these components hinged to one another there is provided a mobile tongue which locks on the indented edge of the bottle. Since each tongue is connected with a lever placed outside the cap, the unlocking of the bottle cap is obtained by acting on said levers.

Notwithstanding the fact that the above-mentioned airtight-sealing caps have solved an important problem, such as the airtight sealing of already opened bottles, it has been noticed that the construction of these caps is rather complicated, since each cap consists of several components, which are then assembled together, with an ensuing high cost both for the materials used and for labour.

One of the purposes of the present invention is that of obtaining an airtight-sealing cap for bottles having an inward indentation at their edge, which is simpler than the analogous known caps available on the market.

More specifically, an object of the present invention is that of obtaining the locking and unlocking of the cap on the inward indentation of the edge without lever movements, which imply the use of at least two components to be assembled with the help of hinges on the cap, but rather by means of the simple reciprocal sliding movement between the two main components constituting the cap.

Another object of the present invention is to provide a cap complete with a safety locking system for preventing the accidental opening of the cap itself.

The above-mentioned objects and others advantages which will be better illustrated here-in-after, are obtained with the construction of a cap which, in accordance with the present invention, includes two essentially cylindrical bodies, the one being contained in the other, coaxially and reciprocally sliding along the main axis, wherein the inside body contains a washer for sealing the opening of the bottle with the help of a spring, characterized by the fact that the locking of the cap on the bottle occurs by means of two or more elements which are horizontally mobile and equally distributed along a circular crown of the inside element and which go to contrast against the lower edge of the bottle neck under the pressure of the outside body of the cap which moves downwards and pushes said mobile elements inward.

According to the present invention, the outside body of the cap has, in fact, its inside surface divided according to three different diameters, arranged in increasing order from the bottom to the top thereof. Thus, when one wants to tighten the cap around the bottle neck, it is enough to slide the outside body in the downward direction, so that the intermediate diameter of said body pushes downward the mobile elements, causing them to rest against the indentation of the bottle neck. When, on the other hand, one wants to unlock the bottle cap, it is sufficient to push said outside body upwards. Naturally, the cap is complete with the necessary ring-shaped washer which rests on the edge of the bottle and is pressed down by a spring, in order to obtain the necessary air-tightness.

An advantage of the present invention is represented by the simplicity of the movement necessary to lock and unlock the cap.

Besides, by turning the outside body by a certain amount, the cap is safely locked on the bottle, since only the rotation in the opposite direction allows the outside body to move upward, thus letting the mobile elements disconnect themselves from the bottle neck, thereby unlocking the bottle cap.

Another advantage of the present invention consists in a decrease in the number of components of the cap as compared with other known constructions, and as a consequence, a decrease in the costs of the cap.

Other details and construction characteristic of the present invention will be better illustrated in a description of a preferred form of the present invention, which is given by way of example only, and thus is not meant to limit the scope of the present invention wherein, FIG. 1 shows a cross-section of the cap of the present invention, resting on a bottle neck;

Figure 1:
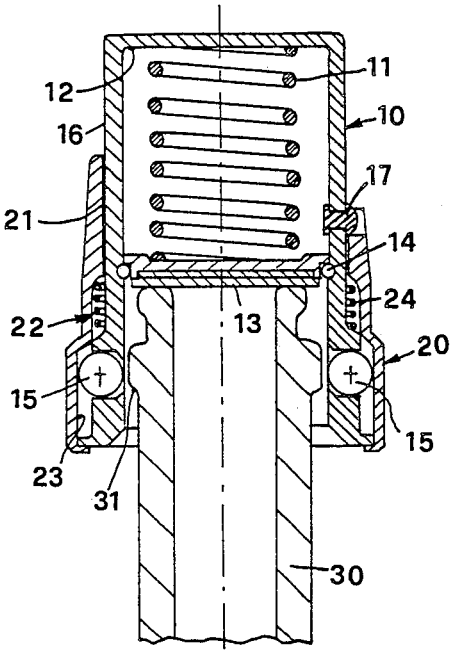
Figure 2:
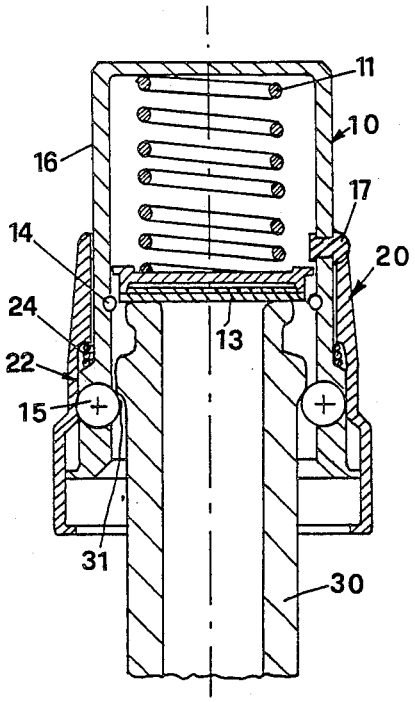
FIG. 2 shows a cross-section of the cap of FIG. 1, being locked on the neck of the same bottle.

With reference to the above-mentioned figures, the inside body of the cap is indicated by 10 and its outside body by 20. Body 10 is closed at the top and contains a spring 11 which rests with one end against the ceiling 12 of said body 10 and with the other against washer 13 which is attached to body 10 by means of an elastic ring 14. In the lower part of the body 10, arranged along a diameter which is larger than the upper part of the body, a series of balls 15 are distributed at an equal distance along a circular crown. They are inserted from the inside toward the outside in radial tapered holes. As can be seen in FIG. 1, the outside body 20 for three different internal diameters which corresponds with surfaces 21, 22 and 23 respectively. The diameter of surface 21 is the narrowest of the three diameters and its size is such that surface 21 can slide on the outside cylindrical surface 16 of body 10. The diameter of surface 22 is approximately equal to the diameter of the circular crown seating the balls 15, so that, when body 20 slides downwards, as can be seen in FIG. 2, the cylindrical surface 22 acts on the balls and causes them to roll inwardly. Thus the balls arrange themselves around the indented edge 31 of the bottle neck 30. The terminal end 23 of body 20 has a yet larger diameter, as compared with diameter 22 and being such that, when the cap is in its unlocked position, the balls 15 can remain in a position sufficiently toward the outside, so as to allow the free insertion of the bottle neck into the cap.

Observing FIG. 1, which represents a cross-section of the cap simply resting on the bottle neck 30, it can be noticed that the balls 15 cannot arrange themselves under edge 31 of the bottle neck, unless a lowering of body 10 and the downward sliding of body 20 occur.

In order to obtain this it is sufficient, after body 10 has been pressed against the bottle neck, to manually pull downwards the outside body 20, which is normally maintained in the upward position by the bias of a spring 24, which rests against the outside surface of body 20 and is contained within body 20. With the manual downward pushing action, body 20 pulls the inside in the the downward direction and body 10 compresses spring 24 which brings the crown containing the balls into the correct position, so that they can come close to the indented edge 31 of bottle 30. The approach to the edge is possible because the pressure of the outside body 20 against the balls 15 is such that they are forced to partially come out of their seats and arrange themselves against the inward indentation 31 of the bottle neck 30.

More precisely, because of the pressure exerted by the outside body 20 on the balls by its lowering movement, the outside body contacts the balls with its intermediate diameter 22, which is smaller that the preceding diameter 23, and, therefore, forces the balls to move toward the inside and to press against the lower portion of edge 31.

The unlocking of the cap occurs simply by manually pushing the outside body 20 in the upwards direction. Thus the inside diameter 22 goes back to the upward position and the larger diameter 23 resumes its position around the balls 15, thus allowing them to re-enter their seats toward the ouside, being pressed by the bottle edge 31 itself.

On the other hand, if one wants to prevent the cap from opening accidentally and, therefore, wants to secure a safe sealing of the bottle by preventing the chance uncoupling between the cap and the bottle, the cap is provided with a safety stop.

In order to keep the cap in its sealed position, a safety stop consisting of a pivot 17 fixed on body 10 and interacting with the upper edge of body 20 is provided.

Figure 3:
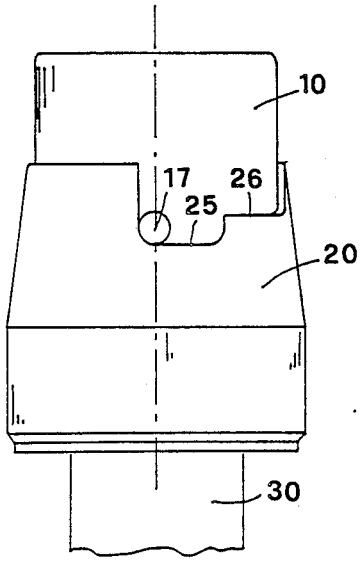
FIG. 3 shows the cap of the present invention before it is locked in its closing position.
Figure 4:
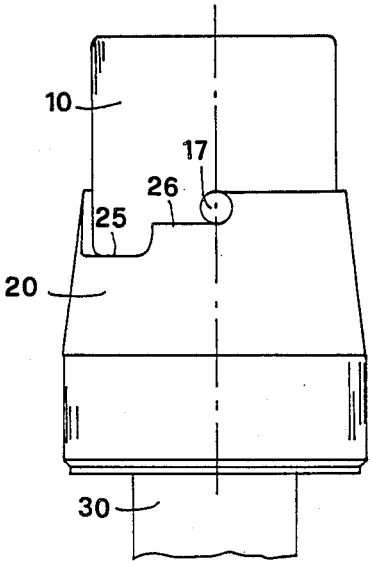
FIG. 4 shows the cap closed with the safety device.

As can be observed in FIGS. 3 and 4, when the cap is simply resting against the edge section 25 of body 20, it leans against pivot 17, while when body 20 is lowered and one wants to secure a safety closure, it is possible to cause the edge section 26 to press against pivot 17, by a simple rotation of a few degrees. Since the edge section 26 is higher than the edge section 25, it becomes clear that body 20 is prevented from moving upwards, and since the balls are pressed against the indented edge 31, the cap is prevented from disengaging itself from the bottle neck.

The release of the safety stop is obtained by reversing the rotation of body 20, so as to bring edge 25 in the direction of the vertical line passing through pivot 17.

The untightening of the cap occurs more easily if a light downward pressure is exerted on body 10 with a simultaneous upward movement of body 20, which causes the balls 15 to re-enter their seats, while releasing them from contact with the indented edge 31.

Figure 5:
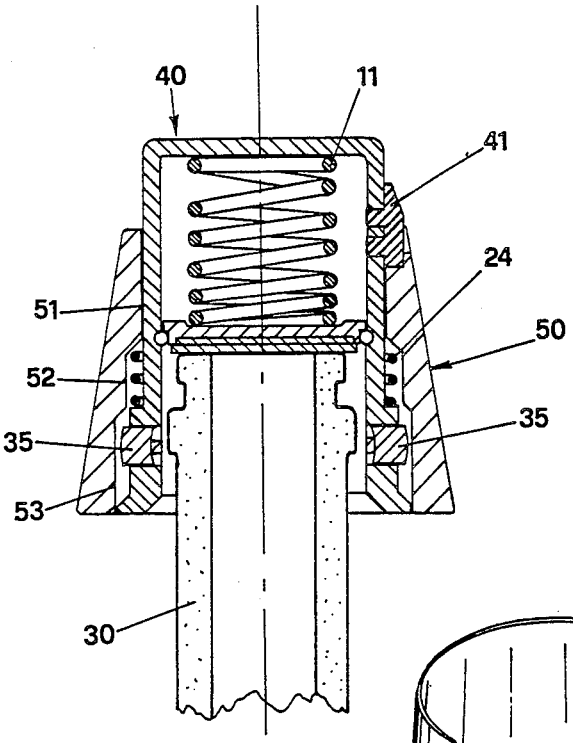
FIG. 5 shows a cross-section of a variation of the cap represented in FIG. 1.
Figure 6:
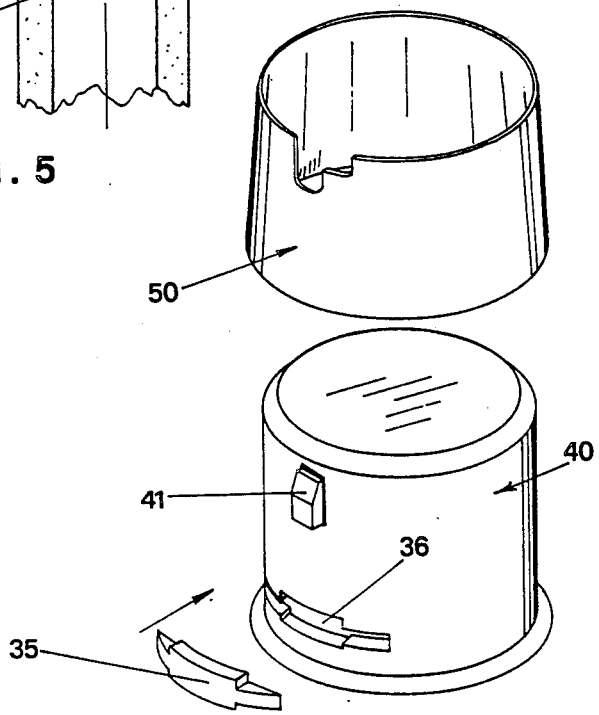
FIG. 6 is an exploded view of the cap of FIG. 5.

A variation of the construction of the present invention is represented in the FIGS. 5 and 6, where it can be observed that the balls 15 have been replaced with the elements 35 having a shape which is reminiscent of a section of a circle. Elements 35 which can easily be obtained by the draw-moulding of plastic material and are provided as at least two separate elements, are inserted into corresponding holes 36 provided along the circumference of body 40. The outside body 50 provides as its inner part, similarly to body 20, three different diameters 51, 52 and 53 respectively, which have sizes increasing from top to bottom, so that this cap works in the same way as the cap illustrated in the preceding figures.

The safety pivot in this construction variation consists of a prismatic element 41 which is inserted into the inside body 40. The just described cap can be made either of metal or of plastic.

Moreover, during the construction phase manufacturing variations may be applied, such as for instance, a different shape of the mobile elements inserted into the slits of the inside body, or the outside shape of the cap, without exceeding, therewith, the scope of the invention, such as it is recited in the following claims.

I claim:

1. A cap particularly suited for providing an airtight sealing for bottles having a peripheral lip on the neck thereof which comprises first and second substantially cylindrical bodies, said first cylindrically body being coaxially and slidably disposed within said second cylindrical body and being closed at one end, a washer means disposed within the first cylindrical body and adapted to seal the opening of the bottle, a first spring means disposed between said washer and said closed end of said first cylindrical body, said first spring means being biased against said washer means, a second spring means disposed between said first and second cylindrical bodies, said second spring means being biased against the slidable movement of the first and second cylindrical bodies relative to each other, a plurality of engaging members operatively confined by the first and second cylindrical bodies and adapted to move in the horizontal and vertical direction whereby upon the application of pressure on the second cylindrical body in the downward, vertical direction against the bias of the second spring means, the plurality of engaging members are displaced to move in substantially the vertical and horizontal direction to engage below said lip on the neck of the bottle.

2. The cap of claim 1 wherein the engaging members are a plurality of balls disposed in a circular crown defined by said first and second cylindrical bodies.

3. The cap of claim 1 wherein the wall of the first cylindrical body contains a horizontal slot for receiving and guiding the movement of the engaging members in the horizontal direction in response to pressure applied to the engaging members from contact with the vertical movement of the second cylindrical body.

4. The cap of claim 1 wherein a safety stop is provided on the cap, said safety stop comprising a pivot means extending from the first cylindrical body and a step-shaped edge surface is provided on the second cylindrical body whereby upon the rotation of the first cylindrical body relative to the second cylindrical body, the step-shaped edge surface engages the pivot means to lock the cap to the neck of the bottle.

* * * * *